US006866237B2

(12) United States Patent
Dagan

(10) Patent No.: US 6,866,237 B2
(45) Date of Patent: Mar. 15, 2005

(54) MAGNETIC SUPPORT STRUCTURE FOR STABLY RETAINING A PRINT MEDIUM OR SIMILAR OBJECT IN A DESIRED POSITION

(76) Inventor: Gideon Dagan, 986 Vernon Ave., Venice, CA (US) 90201

( * ) Notice: Subject to any disclaimer, the term of this patent is extended or adjusted under 35 U.S.C. 154(b) by 0 days.

(21) Appl. No.: 10/439,582

(22) Filed: May 16, 2003

(65) Prior Publication Data

US 2004/0021052 A1 Feb. 5, 2004

Related U.S. Application Data

(63) Continuation-in-part of application No. 10/208,622, filed on Jul. 30, 2002.

(51) Int. Cl.[7] ..... A47G 1/17

(52) U.S. Cl. ..... 248/441.1; 248/206.5; 248/309.4; 40/711; 40/600; 40/661.01

(58) Field of Search ..... 248/206.5, 309.4, 248/441.1, 451, 467; 40/711, 600, 621, 661.01, 124.04; 335/207; 273/456; 473/594, 569; 403/345, 347, 353; 446/132

(56) References Cited

U.S. PATENT DOCUMENTS 2,557,398 A * 6/1951 Teetor ..... 40/124.04
2,557,399 A * 6/1951 Teetor ..... 40/124.04
3,102,362 A * 9/1963 Neal ..... 446/129
3,670,435 A * 6/1972 Steward ..... 40/426
4,411,555 A * 10/1983 Minvielle et al. ..... 405/50
4,525,115 A * 6/1985 Garner, Sr. ..... 411/457
4,807,377 A * 2/1989 Stuckel ..... 40/711
4,822,044 A * 4/1989 Perkitny ..... 273/109
5,184,970 A * 2/1993 Binkley ..... 446/132
5,388,825 A * 2/1995 Myers et al. ..... 473/570
5,842,721 A * 12/1998 Kawabe ..... 281/45
5,895,018 A * 4/1999 Rielo ..... 248/206.5
6,102,768 A * 8/2000 Cho ..... 446/177
6,189,250 B1 * 2/2001 Bell ..... 40/711
6,282,760 B1 * 9/2001 Mars ..... 24/303
2003/0233778 A1 * 12/2003 Gross ..... 40/711

* cited by examiner

*Primary Examiner*—Ramon O. Ramirez
*Assistant Examiner*—Ingrid Weinhold
(74) *Attorney, Agent, or Firm*—Seldon & Scillieri

(57) ABSTRACT

A plurality of individual magnetically-responsive leg-defining bodies are magnetically coupled together through a printed medium such as a photograph, note or other generally similarly shaped object to stably support the medium in a viewed position.

11 Claims, 2 Drawing Sheets

MAGNETIC SUPPORT STRUCTURE FOR STABLY RETAINING A PRINT MEDIUM OR SIMILAR OBJECT IN A DESIRED POSITION

This application is a continuation-in-part of Ser. No. 10/208,622 filed Jul. 30, 2002, the priority of which is claimed.

BACKGROUND OF THE INVENTION

This invention relates to support devices and, more specifically, to structures which are particularly adapted to maintain a print medium such as a photograph, note or other generally similarly shaped object (hereinafter collectively referred to as "print media") in a desired viewable position. More specifically, this invention relates to a support utilizing a magnet to secure the object in the desired position.

Devices for supporting print media on desks, tabletops, bookcase shelves and the like are found in virtually every home and office throughout the world. Some supports are designed to have a certain aesthetic appeal or exhibit amusing characteristics, adding to the visual experience when viewing the displayed object.

SUMMARY OF THE INVENTION

The invention herein utilizes a minimalist art form to stimulate the viewer's curiosity in a novel manner, and to provide a source of amusement without detracting from the viewed print medium. Briefly, a plurality of individual magnetically-responsive support elements are magnetically coupled together through the supported print medium being supported to stably maintain the object in position. Further details about the invention will be discerned from the following description of the preferred embodiment, of which the drawings form a part.

DESCRIPTION OF THE PREFERRED EMBODIMENT

Figure 1:
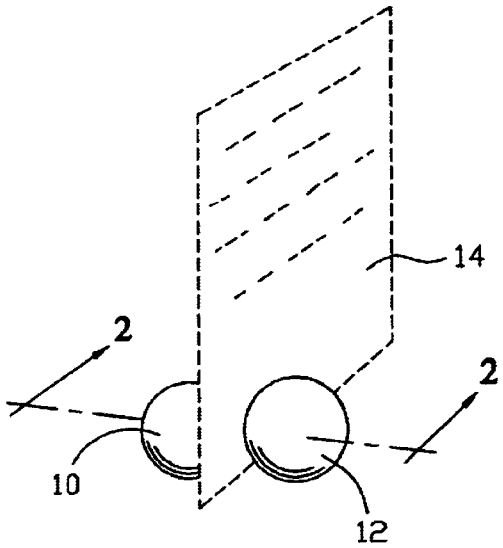
FIG. 1 is a perspective view showing the support of a print medium on a horizontal surface by magnetically-responsive support elements constructed in accordance with the invention on a vertical surface.

FIG. 1 is a perspective view of a magnetically-responsive support assembly constructed in accordance with the invention. The assembly comprises a pair of magnetically responsive support elements 10, 12, which are magnetically coupled to each other through a print medium 14 to be supported on a generally horizontal surface, and positioned with respect to the print medium to function as a pair of supporting legs. As used herein, the term "generally horizontal" refers to any surface, which is less than 30 degrees from true horizontal. The supported print medium 14 may be a note, a photograph, or any other item that one desires to support in a viewable position. The strength of the magnetic filed is sufficient to result in the magnetic intercoupling of the element pair through the print medium. The print medium itself is not part of the invention, and print media of varying shapes, weights and materials can be utilized without departing from the scope of the invention. In addition, it will be recognized that a plurality of print media can be held between the support elements 10, 12, and that the invention is not limited to the supporting of a single print medium therebetween. As can be seen in FIG. 1, the bottom contact surfaces of the support elements 10, 12 are supported by the generally horizontal surface of a table, shelf or the like, with those contact surfaces being sufficiently spaced from each other to provide a stabilizing base.

Figure 2:
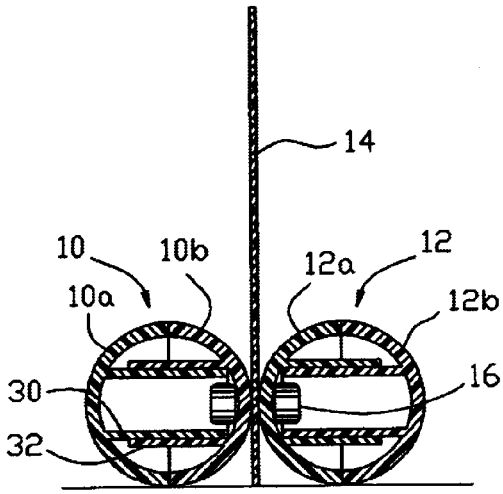
FIG. 2 is a cross-sectional view of the magnetically-responsive supports and supported item taken along line 2—2 of FIG. 1.

FIG. 2 is a cross-sectional view of the magnetically-responsive elements and supported print medium taken along line 2—2 of FIG. 1. The elements 10, 12 are each preferably formed as a substantially hollow ball or cylinder of plastic, and may be painted to appear metallic on order to create a visual perception of a relatively heavy metallic element. Alternatively, they can be painted in any other manner desired, without departing from the spirit of the invention. A small magnet 16 is contained within each element 10, 12 to provide the filed that couples the elements 10, 12 together. In the preferred embodiment, the magnets 16 comprise rare earth magnets, providing strong magnetic attraction with less required weight. Other magnets can be used, of course, and weight may not be a consideration. If fact, heavier magnets may result in a more stable arrangement since the support elements may consequentially have greater resistance to unintended movement than a lighter weight support.

The support elements 10, 12 are each conveniently formed from two generally hollow hemispheric bodies 10*a*, 10*b*, 12*a*, 12*b* which are mated together to form the spherical element. As illustrated in FIG. 2, each hemispherical body may be provided with a respective generally cylindrical wall 30, 32 which extends generally axially from the inner surface of the hemisphere toward the mating hemisphere. The diameter of one of the walls 30 is sized to fit within the other 32 to define an enclosed space in which the magnet 16 is positioned. The magnet is preferably restricted to a direction that is orthogonal to the equatorial seam formed by the mating hemispheres. By this restriction, the seam is substantially hidden from the viewer when the print medium is viewed because the coupled elements present their non-seamed, domed surface to the viewer. Even when one attempts to deliberately couple the elements together at their seams, the elements rotate to align the magnets, thereby rotating the seams out of sight.

Figure 3:
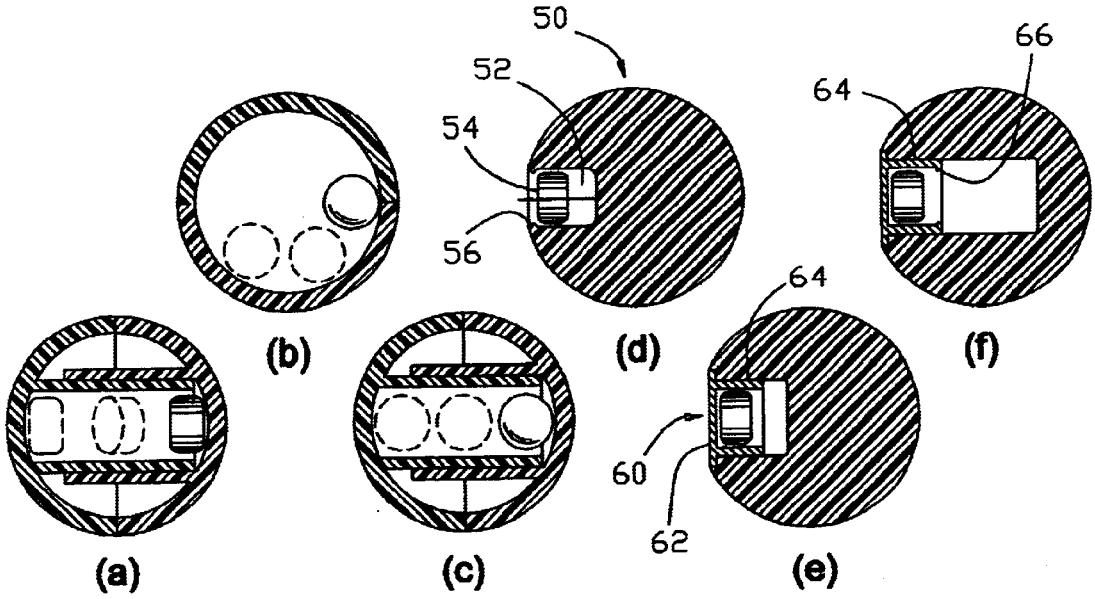
FIGS. 3(*a*)–(*f*) are cross-sectional views of generally similar embodiments of magnetically-responsive support elements constructed in accordance with the invention.

Numerous other internal and external configurations can be imparted to the support elements without departing from the invention, so long as the elements are magnetically coupled form through the print media to form a supporting base. Internally, for example, the magnets can be affixed in place within the elements by glue or other means. Alternatively, the magnets can be permitted to move freely within the support element, as illustrated in FIGS. 3 (*a*)–(*c*). The magnets can have different shapes; for example, they can be cylindrical as illustrated in FIG. 3(*a*) or round as illustrated in FIGS. 3(*b*)–(*c*). They can move freely within the entire element as illustrated in FIG. 3(*b*), or their direction of travel can be limited as illustrated by way of example in FIGS. 3(*a*),(*c*). Moreover, there is no requirement that the support elements forming the magnetically coupled pair have the same internal configuration or the same external appearance; it is only necessary that the support elements magnetically couple through the print medium to provide a stabilizing base. Indeed, only one of the elements needs to contain a magnet if the other support element is simply magnetically responsive.

The configuration of FIGS. 3(*a*) and 3(*c*) minimizes the visibility to the viewer of the equatorial seam formed at the interface between the abutting hemispheres 10*a*, 10*b* by positioning the seam perpendicular to the line of sight, thereby reducing the seam's visibility. As one can appreciate from FIGS. 3(*a*), (*c*), the seam must be oriented in that manner when the support element is magnetically coupled to its mate because the magnets can only move into coupling position in a direction orthogonal to the plane of the seam.

The non-restricted movement of the magnet, such as that illustrated in FIGS. 3(*a*)–(*c*), however, more readily enables the magnetically coupled support pair to be formed from two support elements that differ in internal configuration and/or external shape. Since the magnets can move freely into an orientation providing magnetic coupling independent of any manipulative repositioning of the support elements, coupling is more conveniently achieved than is the case where the magnets are restricted in movement or affixed in place.

FIGS. 3(*d*)–(*f*) are cross-sectional views of alternative embodiments of supporting elements constructed in accordance with the invention. In these embodiments, the support element is generally solid, but includes a hole dimensioned to receive the magnet. The hole may be made by a drilling or boring technique, or may be formed within the mold of a molded support element. FIG. 3(*d*) illustrates an embodiment wherein a relatively shallow hole 52 is formed in the element 50, and a magnet 54 is inserted. A retention lip or ridge 56 is formed around the circumference of the hole 52 to capture the magnet within the hole. The magnet is press fit past the lip, which is sufficiently flexible to permit such passage when sufficient force is applied. Alternatively, a fully circumferential lip or ridge can be replaced by a plurality of circumferentially spaced, inwardly-extending protrusions to accomplish the same function. Those skilled in the art will recognize that this configuration is most practical when the support element is a molded plastic, since the lip is most easily formed by that method and can be provided with the requisite degree of flexibility, but that other materials and methods of formation can be utilized just as well.

FIG. 3(*e*) illustrates an internal configuration for a support element wherein the magnet is retained by a lid 60 that is snapped, glued or press fit into the hole to seal the magnet inside. The illustrated lid is part of a plug comprising an exterior face 62 that captures the magnet within the support element, and an inwardly-extending body portion 64 that fits within the hole and generally surrounds the magnet. The inwardly-extending body portion can be generally cylindrical in shape, or of any other configuration which accomplishes the function. For example, it may comprise a plurality of inwardly-extending finger-like elements circumferentially disposed about the magnet to capture it therebetween.

The exterior surface of the lid 60 is preferably flush with the exterior surface of the support element that surrounds it, and preferably provides a flat surface that lodges against the supported print medium when magnetically coupled to the support element on the opposite side. Since, however, this orientation masks the lid from view when the element is in use, its appearance may not be important to some users.

FIG. 3(*f*) illustrates an internal configuration similar to FIG. 3(*e*). However, the innermost region of the inwardly-extending body portion 64 in this configuration has a magnet-capturing ridge 66 that limits the depth into the support element of the magnet's travel. This prevents the magnet from moving close enough to the element's surface opposite the plug that magnetic coupling occurs through that opposite side to thereby expose the plug to view. Consequently, the support element can only be coupled to the element on the opposite side of the print medium with the plug up against the supported print medium and out of view. It will be recognized that the ridge 66 need not be continuous, but can consist of circumferentially disposed protrusions or other blocking surfaces which yield the same result.

The magnetic elements can be glued or otherwise affixed within the interior of the support elements, rather than being permitted to move, regardless of the embodiment. For example, the magnet can be affixed to the interior surface of the support element, to the cylindrical wall 30 (FIG. 2), to the plug (FIGS. 3(*e*)–(*f*)) or to any other convenient surface. Alternatively, the magnets can be permitted to move freely within the hole 52 or plug. As noted above, free movement of the magnets provides greater flexibility by substantially eliminating the need for matched pairs of support elements. For example, a first support element having a north pole of an affixed magnet facing the mating element must mate with a second support element having the south pole of an affixed magnet facing the first support element. "North pole" elements must be packaged and used with "south pole" elements, causing manufacturing and packaging controls to assure that the proper number of each are sold as a set. Collections of support elements must be evenly divided between the two types of elements. Only half the elements in a given package can mate with the other half. When the magnets can move, the poles will self-align regardless of the specific elements chosen to form the mating pair, yielding greater simplicity in inventorying and packaging collections of such elements, and providing more combinations of usable elements and greater convenience to the user.

As illustrated in FIGS. 3(*a*) and 3(*c*), the magnets themselves need not be any particular shape. The magnets can be cylindrical, spherical, or of any other desired size or shape without departing from the scope of the invention. It is only necessary that the support elements magnetically couple through the print medium to provide a stabilizing base.

Figure 4:
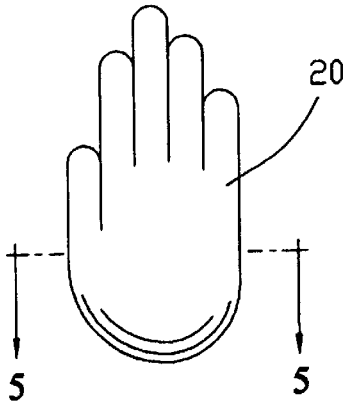
FIG. 4 is a front elevation view of another embodiment of a magnetically responsive support element constructed in accordance with the invention.
Figure 5:
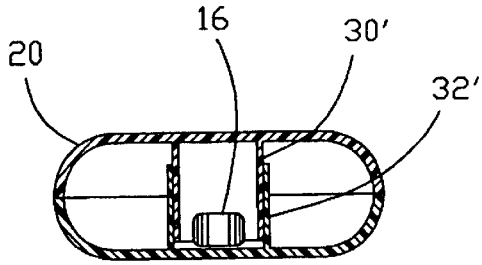
FIG. 5 is a cross-sectional view of the support element of FIG. 4, taken along line 5—5 in FIG. 4.

Likewise, the external configuration of the support elements need not be spherical as illustrated in FIGS. 1 and 3(*a*)–(*c*), but need only provide sufficiently large areas of contact with the generally horizontal surface to prevent lateral movement. Accordingly, the elements may be squares, triangles, pyramids, or any other regular or irregular shape. An example of a non-spherical support element in illustrated in FIG. 4, which is a front elevation view of a support member in the shape of a human hand. FIG. 5 is a cross-sectional view of the support element of FIG. 4, taken along line 5—5 therein. Like the elements 10, 12 of FIGS. 3(*a*)–(*c*), the support element 20 may include a pair of generally cylindrical walls 30', 32' that define an enclosed space for the magnet 16, or may simply permit the magnet 16 to move freely within the base of the support element.

In addition, the magnetically-responsive elements may include vertically-extending members sized and positioned to sandwich the vertical edges of the displayed item between them, thereby providing additional stability, particularly where the displayed item is too thin to extend upward of its own material strength.

addition, it should be recognized that two magnetically coupled pairs of support elements can be utilized, with one mating pair located adjacent each bottom corner of the supported print medium to add additional stability, acting in effect as four supporting legs: two in front of the print medium and two behind the print medium.

Figure 6:
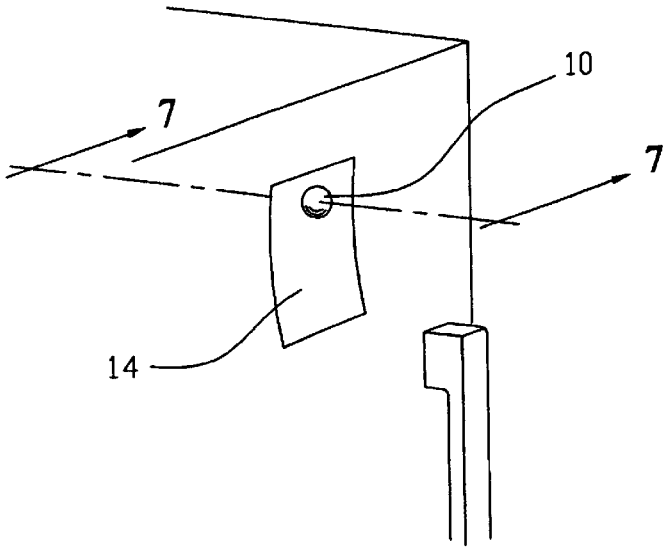
FIG. 6 is a front perspective view of a magnetically-responsive support constructed in accordance with the invention, and securing a note or photograph against a generally vertical surface.
Figure 7:
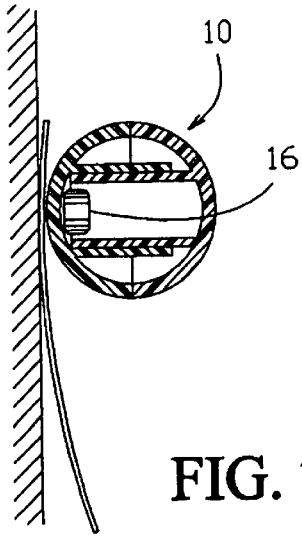
FIG. 7 is a cross-sectional view of the magnetically-responsive element of FIG. 4, taken along line 7—7 therein.

It should be noted that the support elements disclosed herein are not limited to use with generally horizontal surfaces. FIG. 6 is a front perspective view of a magnetic support element 10 constructed in accordance with the invention, and securing a displayed print medium 14 against a generally vertical surface; namely a refrigerator door. FIG. 7 is a cross-sectional view of the magnetic element of FIG. 6 taken along line 7—7 therein. Where the vertical surface is not magnetic or magnetically responsive, one or more mating support elements can be placed behind the vertical surface, provided that (1) the mating support element can be positioned behind the vertical surface and (2) the magnetic coupling is sufficiently strong to overcome the pull of gravity. The support elements, themselves, can have any of the previously discussed and/or illustrated shapes and internal configurations, and need not be externally or internally identical so long as magnetic coupling results.

While the foregoing description includes detail, which will enable those skilled in the art to practice the invention, it should be recognized that the description is illustrative in nature and that many modifications and variations will be apparent to those skilled in the art having the benefit of these teachings. It is, accordingly, intended that the invention herein be defined solely by the claims appended hereto and that the claims be interpreted as broadly as permitted in light of the prior art.

What is claimed:

1. A support assembly for stably retaining a print medium in position on a generally horizontal surface, and comprising:

at least one pair of magnetically couplable support elements sized and shaped for magnetic coupling to each other through the print medium so that the elements are supported by the generally horizontal surface and provide a supportive base thereon for the print medium, at least one of said support elements being formed from a pair of mating body portions of magnetically non-responsive material having respective interior and exterior wall surfaces and a respective mating face extending therebetween, said faces mating with each other along at least one seam to form a generally hollow shell defined by said interior and exterior wall surfaces.

each of the mating body portions having an open-ended, generally cylindrical wall extending inwardly from its interior wall towards and beyond its mating face, the respective sizes and positions of the generally cylindrical walls being such that the inwardly-extending cylindrical wall of one of the body portions forms a generally enclosed space within the support element in cooperation with the inwardly-extending generally cylindrical wall of the other body portion when the two body portions are mated to form the support element; and a magnet having a north pole and a south pole and positioned within the generally enclosed space, said magnet being sized to move freely within the generally enclosed space so that either of said poles can generally abut an interior wall surface of either body portion.

2. The support element assembly of claim 1 wherein the support element is formed from two generally hemispheric bodies mated together.

3. The support element of claim 2 wherein the two generally hemispheric bodies are mated together along a generally equatorial seam.

4. The support element assembly of claim 3 wherein the generally cylindrical walls extend generally orthogonally to the generally equatorial seam.

5. A support assembly for stably retaining a print medium in position on a generally horizontal surface, and comprising at least one pair of magnetically couplable support elements sized and shaped for magnetic coupling to each other through the print medium so that the elements are supported by the generally horizontal surface and provide a supportive base thereon for the print medium, at least one of said support elements being formed from a pair of mating body portions of magnetically non-responsive material that mate with each other along at least one seam to form a generally hollow shell having interior and exterior surfaces, a wall structure extending across the interior of said at least one support element to enclose a generally cylindrical space that extends between generally diametrically opposite regions of the shell's interior walls, a magnet having a north pole and a south pole and positioned within the generally cylindrical space, said magnet being sized to move freely within the generally cylindrical space so that it can generally abut either of the diametrically opposite interior wall regions.

6. The support assembly of claim 5, wherein the magnet is sized to move freely within the generally cylindrical space so that its north pole can generally abut either of the diametrically opposite interior wall regions.

7. A support assembly for stably retaining a print medium in position on a generally horizontal surface, and comprising at least one pair of magnetically couplable support elements sized and shaped for magnetic coupling to each other through the print medium so that the elements are supported by the generally horizontal surface and provide a supportive base thereon for the print medium, at least one of said support elements being formed from a pair of mating body portions of magnetically non-responsive material that mate with each other along at least one seam to form a generally hollow shell having interior and exterior surfaces, a wall structure extending across the interior of said at least one support element to enclose a generally cylindrical space that extends between generally diametrically opposite regions of the shell's interior walls, a respective portion of the wall structure being carried by each of the mating body portions so as to enclose said generally cylindrical space when the body portions are mated;

a magnet having a north pole and a south pole and captured within the generally cylindrical space, said magnet being sized to move freely within the generally cylindrical space so that it can generally abut either of the diametrically opposite interior wall regions.

8. The support assembly of claim 7 wherein the magnet is sized to move freely within the generally cylindrical space so that its north pole can generally abut either of the diametrically opposite interior wall regions.

9. A support assembly for stably retaining a print medium in position on a generally horizontal surface, and comprising:

at least one pair of magnetically couplable support elements sized and shaped for magnetic coupling to each other through the print medium so that the elements are supported by the generally horizontal surface and provide a supportive base thereon for the print medium, at least one of said support elements being formed from a pair of mating body portions of magnetically non-responsive material that mate with each other along at least one seam to form a generally hollow shell having interior and exterior surfaces, each one of the mating body portions having a respective internal wall structure that cooperates with the internal wall structure of the other one of the mating body portions to define a generally cylindrical, generally enclosed space extending across the interior of said at least one support element between generally diametrically opposite regions of the shell's interior walls; and a magnet having a north pole and a south pole and captured within the generally cylindrical space, said magnet being sized to move freely within the generally cylindrical space so that it can generally abut either of the diametrically opposite interior wall regions.

10. A support assembly for stably retaining a print medium in position on a generally horizontal surface, and comprising:

at least one pair of magnetically couplable support elements sized and shaped for magnetic coupling to each other through the print medium so that the elements are supported by the generally horizontal surface and provide a supportive base thereon for the print medium, at least one of said support elements being formed from a body of magnetically non-responsive material having a magnet-receiving bore extending generally radially into said body, a magnet having a north pole and a south pole positioned within said magnet-receiving bore and sized to freely move in said generally radial direction within the bore, and means for retaining said magnet within the bore.

11. The support assembly of claim 10 wherein the bore and the magent are respectively sized to permit the magnet to rotate its poles about an axis generally orthogonal to said radial direction.

* * * * *